US007621827B2

(12) United States Patent
Sajima

(10) Patent No.: US 7,621,827 B2
(45) Date of Patent: Nov. 24, 2009

(54) GOLF BALL

(75) Inventor: Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/905,800

(22) Filed: Oct. 4, 2007

(65) Prior Publication Data

US 2008/0125249 A1 May 29, 2008

(30) Foreign Application Priority Data

Nov. 28, 2006 (JP) ..... 2006-320037

(51) Int. Cl.
*A63B 37/12* (2006.01)

(52) U.S. Cl. ..... 473/379

(58) Field of Classification Search ..... 473/383–385, 473/379

See application file for complete search history.

(56) References Cited

U.S. PATENT DOCUMENTS

| | | | | |
|---|---|---|---|---|
| 5,249,804 | A * | 10/1993 | Sanchez | 473/379 |
| 5,332,226 | A * | 7/1994 | Kim | 473/384 |
| 6,811,498 | B2 * | 11/2004 | Emerson et al. | 473/377 |
| 2002/0016229 | A1 * | 2/2002 | Emerson et al. | 473/379 |
| 2002/0077198 | A1 | 6/2002 | Sajima et al. | |
| 2003/0171167 | A1 | 9/2003 | Kasashima et al. | |
| 2005/0037871 | A1 * | 2/2005 | Nardacci | 473/378 |
| 2007/0093320 | A1 * | 4/2007 | Bissonnette et al. | 473/383 |
| 2007/0149322 | A1 * | 6/2007 | Aoyama et al. | 473/378 |

FOREIGN PATENT DOCUMENTS

| | | | |
|---|---|---|---|
| JP | 2001-514058 | A | 9/2001 |
| JP | 2002126127 | | 5/2002 |
| JP | 2003260151 | A2 | 9/2003 |
| WO | WO-99/11331 | A1 | 3/1999 |

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has numerous dimples 8. The surface of the golf ball is divided by comparting lines CM corresponds to edges of a regular icosahedron into eight first spherical regular triangles T1, six second spherical regular triangles T2, and six third spherical regular triangles T3. The first spherical regular triangles T1 do not include the equatorial line EQ. The second spherical regular triangles T2 and the third spherical regular triangles T3 include the equatorial line EQ. The dimple pattern on the first spherical regular triangle T1 is different from the dimple patterns on the second spherical regular triangle T2 and third spherical regular triangle T3. The dimple pattern on the first spherical regular triangle T1 has rotational symmetry and line symmetry. The dimple pattern on the second spherical regular triangle T2 and the third spherical regular triangle T3 has neither a rotational symmetry nor line symmetry. This golf ball 2 does not have any great circle path.

7 Claims, 12 Drawing Sheets

GOLF BALL

This application claims priority on Patent Application No. 2006-320037 filed in JAPAN on Nov. 28, 2006. The entire contents of this Japanese Patent Application are hereby incorporated by reference.

BACKGROUND OF THE INVENTION

1. Field of the Invention

The present invention relates to golf balls. More particularly, the present invention relates to improvement of dimples of golf balls.

2. Description of the Related Art

Golf balls have numerous dimples on the surface thereof. The dimples disrupt the airflow around the golf ball during its flight to cause turbulent flow separation. By causing the turbulent flow separation, separating points of the air from the golf ball shift backwards leading to the reduction of drag. The turbulent flow separation prolongs the gap between the separating point on the upper side and the separating point on the lower side of the golf ball, which results from the back spin, thereby enhancing the lift force that acts upon the golf ball. Reduction in drag and elevation of lift force are referred to as "the dimple effect". Excellent dimples disrupt the air flow more efficiently. Owing to the excellent dimples, great flight distance can be achieved.

In general, golf balls are formed using a mold having an upper mold half and a lower mold half. The upper mold half and the lower mold half each has a hemispherical cavity. Assuming that the upper mold half cavity is northern hemisphere of the globe and that the lower mold half cavity is southern hemisphere of the globe, an equatorial line will correspond to a parting line of the mold. Numerous protrusions are provided on the inner surface of the mold, and dimples are formed on the surface of the golf ball by means of the protrusions. The dimple has a shape reversed from the shape of the protrusion.

In molding, because the material (for example, synthetic resin) leaks outside from the parting line, a flash is generated along the equatorial line on the surface of the golf ball. This flash is ground and removed with a sand belt or the like. Because the dimples are recessed, removal of the flash generated inside the dimple is difficult. For ease in removal, no dimple is formed on the equatorial line. In other words, no protrusion is provided on the parting line of the mold. A great circle which does not intersect with the dimple (i.e., a great circle path) is formed on the equatorial line of the golf ball. When this great circle path agrees with a part where the greatest circumferential speed of the back spin is attained (hereinafter, referred to as "fastest part"), sufficient dimple effect cannot be achieved. Furthermore, the dimple effect achieved when the great circle path agrees with the fastest part is different from the dimple effect achieved when the great circle path does not agree with the fastest part. The difference between these dimple effects may deteriorate aerodynamic symmetry of the golf ball.

In light of the dimple effect, a mold having parting line with a concavo-convex shape was proposed. The golf ball obtained from this mold has no great circle path. This mold generates a flash having a concavo-convex shape. Grinding of the flash results in deformation of the dimple in the vicinity of the equatorial line. Thus deformed dimple cannot be responsible for the dimple effect enough. Also, this golf ball may not achieve sufficient dimple effect when the equatorial line agrees with the fastest part. This golf ball does not exhibit sufficient aerodynamic symmetry.

A regular polyhedron is often used for arranging the dimples. The regular polyhedron that is inscribed in the phantom spherical surface is envisioned, and edges of this regular polyhedron are projected on the phantom spherical surface by a ray of light emitted from the center of the sphere to the phantom spherical surface so as to form comparting lines. The comparting lines compart the phantom spherical surface, and the dimples are arranged. Examples of the regular polyhedron which may be used include regular hexahedron, regular octahedron, regular dodecahedron and regular icosahedron. In most common golf balls, a regular icosahedron has been used for arranging the dimples. The regular icosahedron results in formation of regular polygons in large numbers on the phantom spherical surface. The regular icosahedron achieves excellent uniformity.

WO99/11331 (JP No. 2001-514058) discloses a dimple pattern formed with a regular icosahedron. FIGS. 3 and 4 of this document illustrate a golf ball having 362 dimples. The surface of this golf ball can be comparted into twenty spherical regular triangles. Dimple patterns on all the spherical regular triangles are equivalent. This golf ball is formed using a mold the parting line of which has an concavo-convex shape. This golf ball does not have a great circle path.

The golf ball disclosed in the aforementioned document is not accompanied by any defect in aerodynamic symmetry resulting from the great circle path. However, difficulties may be involved in production of the mold in the case of this type of golf balls. Additionally, grinding of the flash may cause deformation of many dimples according to this golf ball. This golf ball does not solve the problem of defects in aerodynamic symmetry resulting from the grinding of the flash. There remains room for improvement of the aerodynamic symmetry of this golf ball. An object of the present invention is to provide a golf ball that is excellent in aerodynamic symmetry.

SUMMARY OF THE INVENTION

The golf ball according to the present invention has numerous dimples on the surface thereof. This golf ball does not have a great circle which does not intersect with the dimple. When the phantom spherical surface thereof is comparted by thirty comparting lines, being formed by projecting thirty edges of a regular icosahedron inscribing the phantom spherical surface on the phantom spherical surface, into spherical regular icosahedrons consisting of multiple spherical regular triangles including the equatorial line and multiple spherical regular triangles not including the equatorial line, the dimple pattern on the spherical regular triangle not including the equatorial line being different from the dimple pattern on the spherical regular triangle including the equatorial line.

In the golf ball according to the present invention, the dimple effect achieved when the fastest part agrees with the equatorial line is enhanced by the dimple pattern on the spherical regular triangle including the equatorial line. This golf ball is excellent in the aerodynamic symmetry.

Preferably, at all twelve vertices of the spherical regular icosahedrons, there exists a dimple the center of which agrees with the corresponding vertex. In addition, all the spherical regular triangles have six or more dimples the center of which agrees with the comparting line, respectively.

Preferably, the number of types of the dimples on one spherical regular triangle including the equatorial line is different from the number of types of the dimples on one spherical regular triangle not including the equatorial line. Preferably, the dimple pattern on the spherical regular triangle including the equatorial line has neither a rotational symmetry nor line symmetry. Preferably, the golf ball has twelve spherical regular triangles including the equatorial line, and eight spherical regular triangles not including the equatorial line.

Preferably, the golf ball has a spherical regular triangle including the equatorial line and having a certain dimple pattern, and a spherical regular triangle including the equatorial line and having other dimple pattern. The certain dimple pattern is different from the other dimple pattern.

Preferably, the golf ball has a spherical regular triangle not including the equatorial line and having a certain dimple pattern, and a spherical regular triangle not including the equatorial line and having other dimple pattern. The certain dimple pattern is different from the other dimple pattern.

DESCRIPTION OF THE PREFERRED EMBODIMENTS

Hereinafter, the present invention will be described in detail according to the preferred embodiments with appropriate references to the accompanying drawings.

Figure 1:
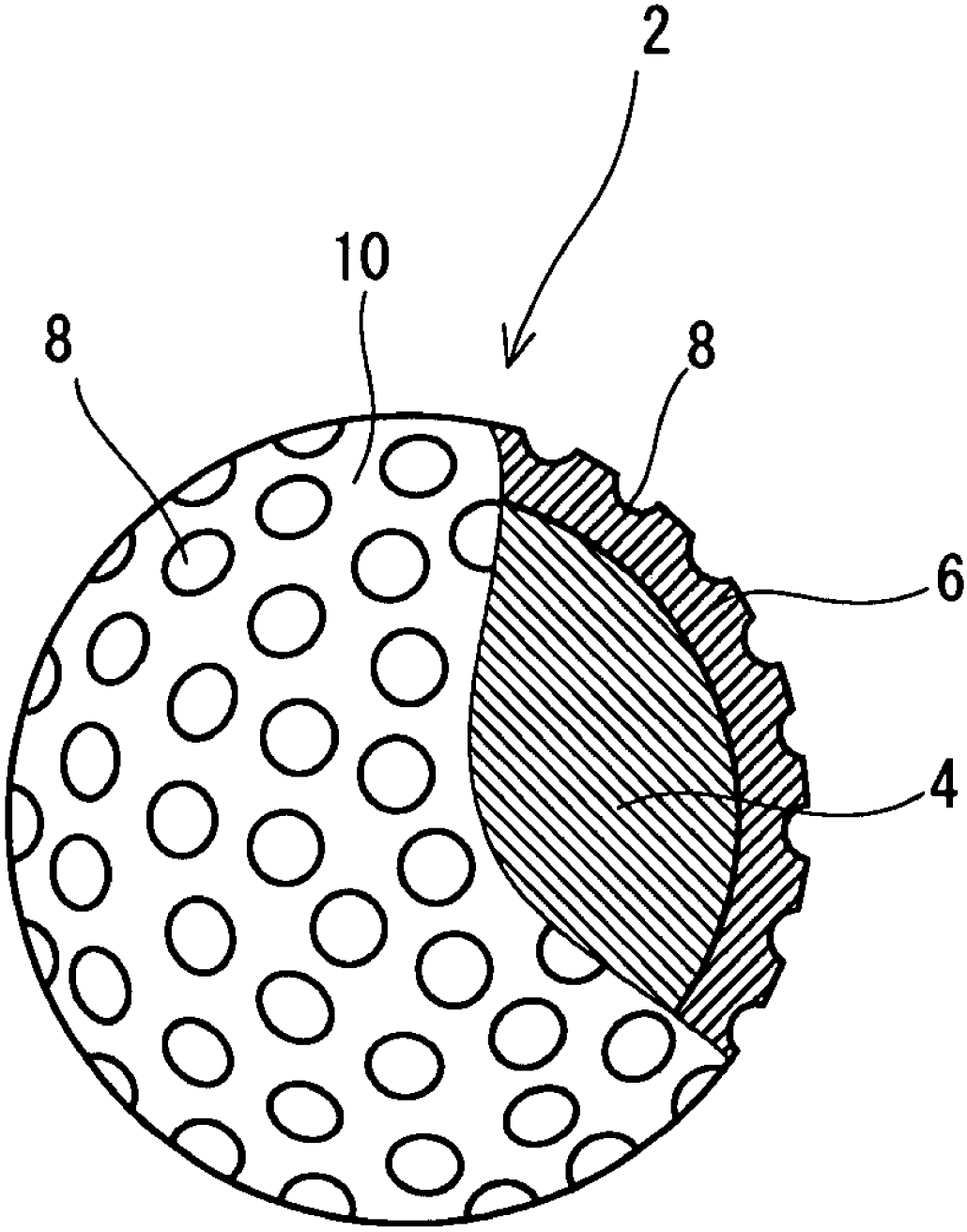
FIG. 1 shows a schematic cross-sectional view illustrating a golf ball according to one embodiment of the present invention.

Golf ball 2 shown in FIG. 1 has a spherical core 4 and a cover 6. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure. A mid layer may be provided between the core 4 and the cover 6.

This golf ball 2 has a diameter of 40 mm or greater and 45 mm or less. From the standpoint of conformity to a rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. Weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is more preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and high cis-polybutadienes are particularly preferred.

For crosslinking of the core 4, a co-crosslinking agent is suitably used. Examples of the co-crosslinking agent that are preferable in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a sulfur compound, a filler, an anti-aging agent, a coloring agent, a plasticizer, a dispersant and the like may be blended in an adequate amount into the rubber composition of the core 4 as needed. Into the rubber composition may be also blended crosslinked rubber powder or synthetic resin powder.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core 4 may be composed of two or more layers.

Polymer which may be suitably used in the cover 6 is an ionomer resin. Examples of preferred ionomer resin include binary copolymers formed with $\alpha$-olefin and an $\alpha$, $\beta$-unsaturated carboxylic acid having 3 or more and 8 or less carbon atoms. Examples of other preferred ionomer resin include ternary copolymers formed with $\alpha$-olefin, an $\alpha$, $\beta$-unsaturated carboxylic acid having 3 or more and 8 or less carbon atoms, and an $\alpha$,$\beta$-unsaturated carboxylate ester having 2 or more and 22 or less carbon atoms. In the binary copolymer and ternary copolymer, preferable $\alpha$-olefin is ethylene and propylene, and preferable $\alpha$, $\beta$-unsaturated carboxylic acid is acrylic acid and methacrylic acid. In the binary copolymer and ternary copolymer, a part of the carboxyl group is neutralized with a metal ion. Illustrative examples of the metal ion for use in neutralization include sodium ion, potassium ion, lithium ion, zinc ion, calcium ion, magnesium ion, aluminum ion and neodymium ion.

Other polymer may be used in place of or together with the ionomer resin. Illustrative examples of the other polymer include thermoplastic polyurethane elastomers, thermoplastic styrene elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a thickness of equal to or greater than 0.3 mm, and particularly equal to or greater than 0.5 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover 6 may be composed of two or more layers.

Figure 2:
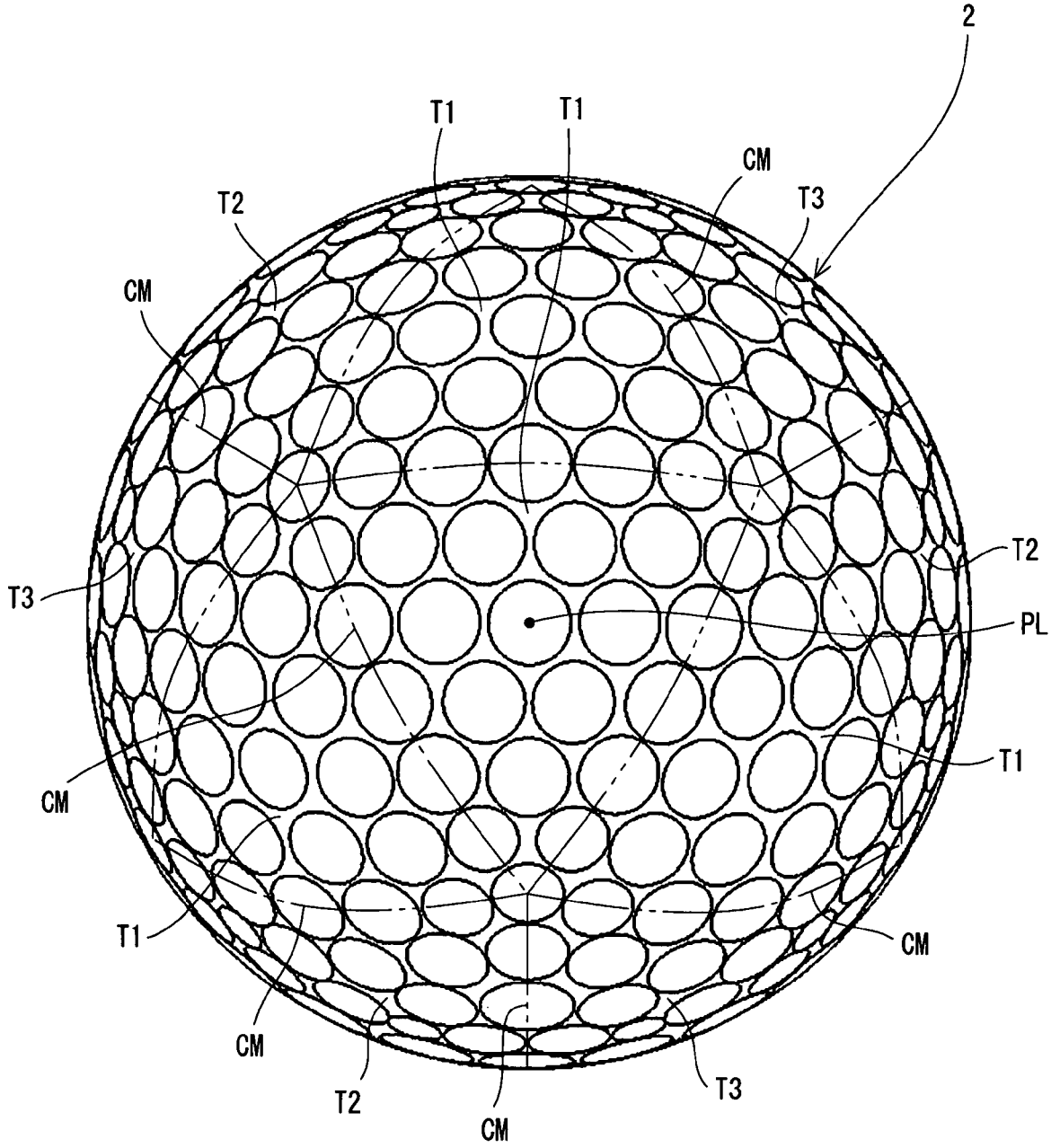
FIG. 2 shows an enlarged plan view illustrating the golf ball shown in FIG. 1.
Figure 3:
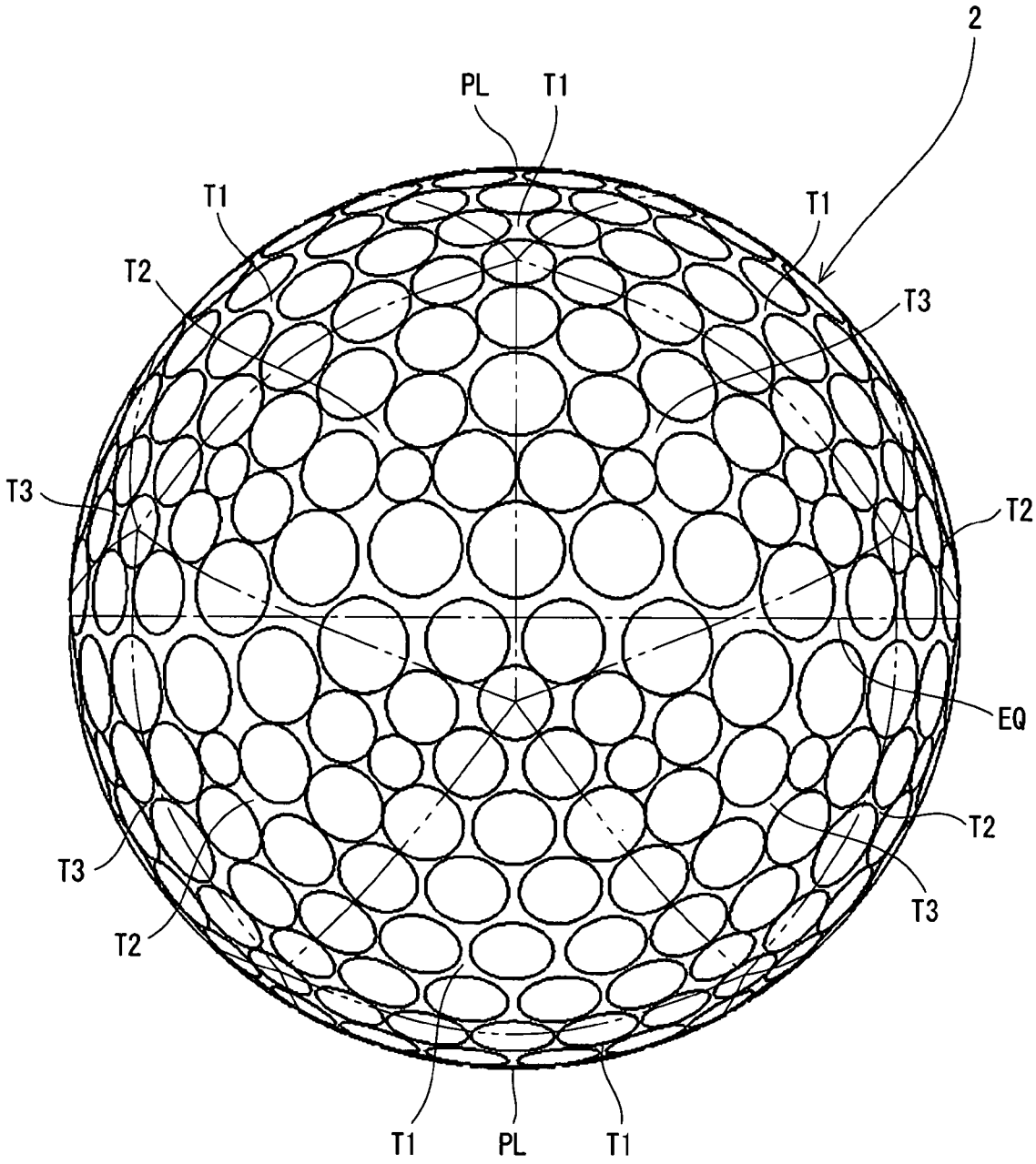
FIG. 3 shows a front view illustrating the golf ball shown in FIG. 2.
Figure 4:
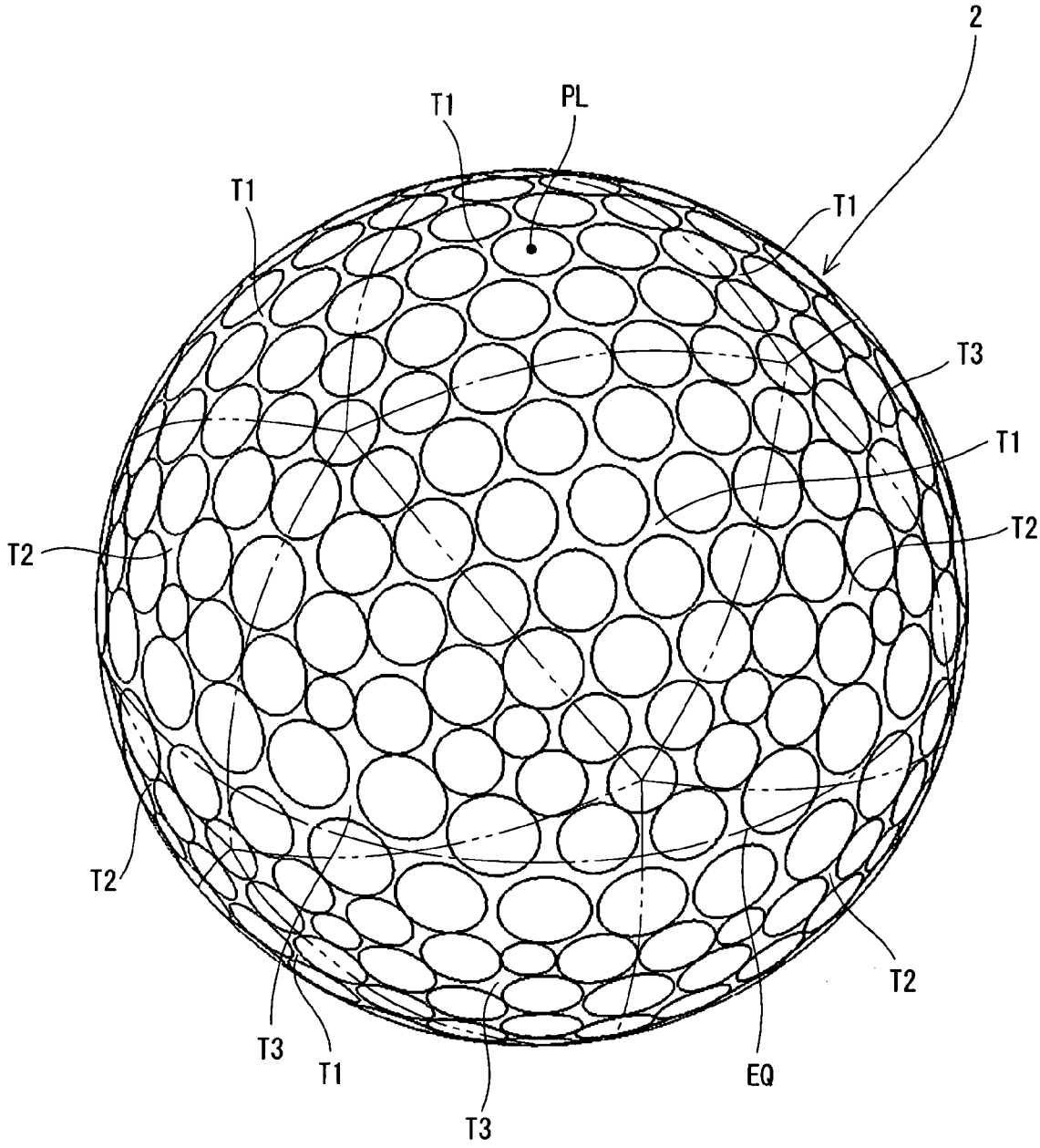
FIG. 4 shows a perspective view illustrating the golf ball shown in FIG. 2.

FIG. 2 shows an enlarged plan view illustrating the golf ball 2 shown in FIG. 1. FIG. 3 shows a front view illustrating the golf ball 2 shown in FIG. 2. FIG. 4 shows a perspective view illustrating the golf ball 2 shown in FIG. 2. A bottom plan view of this golf ball 2 is identical with the view shown in FIG. 2. In FIGS. 2 to 4, comparting lines CM are indicated by a chain double-dashed line. The comparting line CM is provided by projecting edges of a regular icosahedron that is inscribed in the phantom spherical surface. Because the regular icosahedron has 30 edges, the number of the comparting lines CM is also 30. These comparting lines CM divide the phantom spherical surface into 20 spherical regular triangles. In FIGS. 2 to 4, a first spherical regular triangle is indicated by the reference sign T1; a second spherical regular triangle is indicated by the reference sign T2; and a third spherical regular triangle is indicated by the reference sign T3.

As is clear from FIG. 2, the pole PL is included in the first spherical regular triangle T1. The first spherical regular triangle T1 including the pole PL is adjacent to three other first spherical regular triangles T1. In this golf ball 2, four first spherical regular triangles T1 are present on the northern hemisphere, and four first spherical regular triangles T1 are present on the southern hemisphere. The number of the first spherical regular triangles T1 is eight. The first spherical regular triangles T1 do not include the equatorial line EQ. Dimple patterns on the eight first spherical regular triangles T1 are identical with each other.

This golf ball 2 has six second spherical regular triangles T2. As is clear from FIGS. 3 and 4, the second spherical regular triangles T2 include the equatorial line EQ. Dimple patterns on the six second spherical regular triangles T2 are identical.

This golf ball 2 has six third spherical regular triangles T3. As is clear from FIGS. 3 and 4, the third spherical regular triangles T3 include the equatorial line EQ. Dimple patterns on the six third spherical regular triangles T3 are identical.

Figure 5:
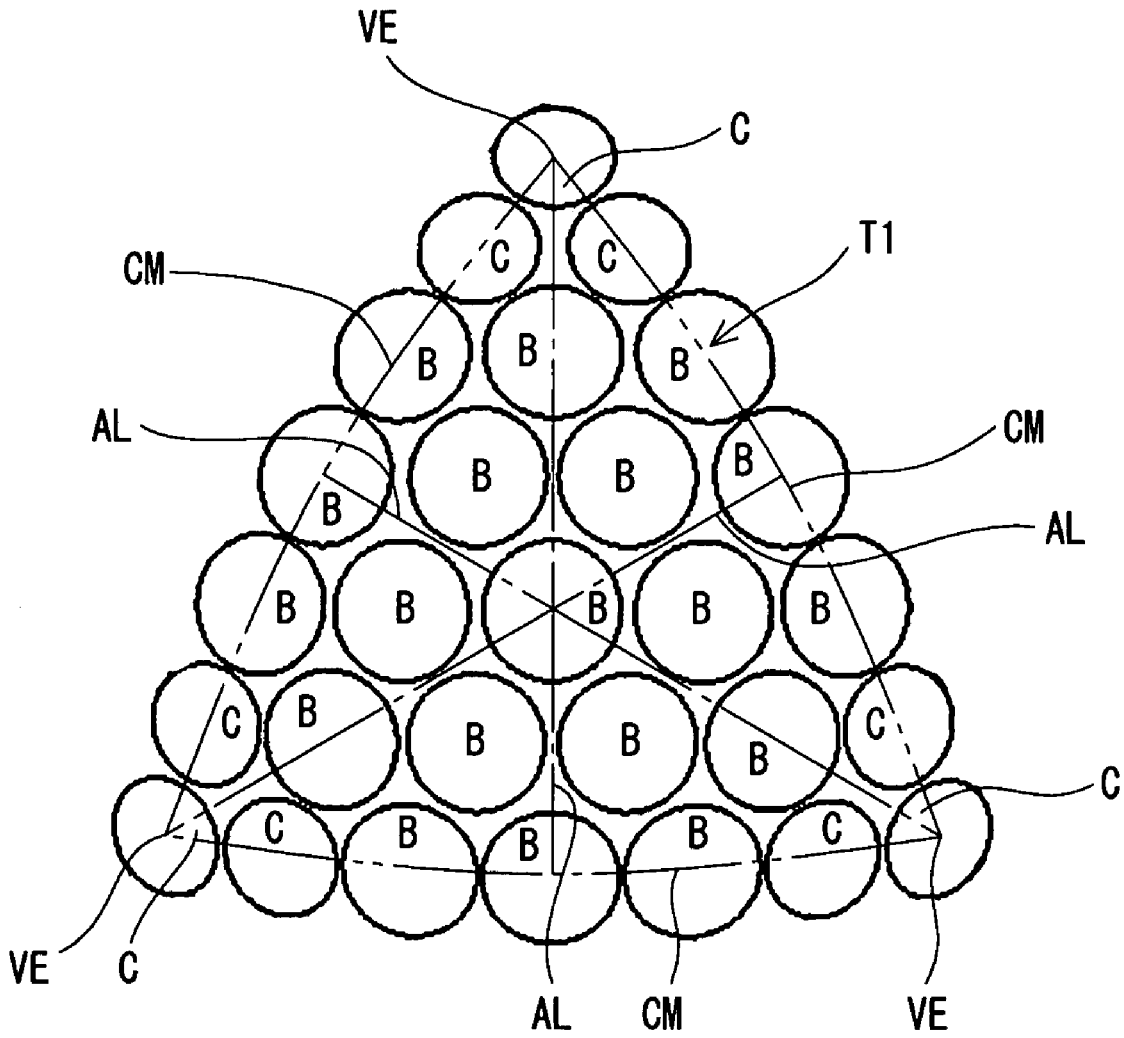
FIG. 5 shows a front view illustrating a first spherical regular triangle of the golf ball shown in FIG. 2.

FIG. 5 shows a front view illustrating the first spherical regular triangle T1. The first spherical regular triangle T1 has three comparting lines CM, and three vertices VE. The first spherical regular triangle T1 includes dimples B and dimples C. The dimple B has a diameter of 4.0 mm. The dimple C has a diameter of 3.5 mm. The first spherical regular triangle T1 has two types of the dimples 8 having a diameter different from each other.

At each vertex VE of the first spherical regular triangle T1, there exists the dimple C. The center of this dimple C agrees with the vertex VE. Each comparting line CM intersects with three dimples B and two dimples C except for the vertex VE. The center of the dimple 8 that intersects with the comparting line CM is positioned on the comparting line CM. This state is referred to as intersection at the center. The first spherical regular triangle T1 has fifteen dimples 8 which intersect with the comparting line CM at their center. In the first spherical regular triangle T1, the number of the dimples 8 that intersect with the comparting line CM but do not intersect therewith at the center is zero.

The dimple pattern on the first spherical regular triangle T1 has rotational symmetry through 120° around the center as an axis. In other words, when this dimple pattern is rotated through 120° about the center, it substantially overlaps with the original dimple pattern. Herein, the state of "substantial overlapping" includes not only the state in which the dimple 8 completely agrees with the corresponding dimple 8, but also the state in which the dimple 8 is deviated to some extent from the corresponding dimple 8. Herein, the state of "being deviated to some extent" includes the state in which the center of the dimple 8 is away to some extent from the center of the corresponding dimple 8. The distance between the center of the dimple 8 and the center of the corresponding dimple 8 in the state of being substantially overlapping is preferably equal to or less than 1.0 mm, and more preferably equal to or less than 0.5 mm. Herein, the state of "being deviated to some extent" includes the state in which the dimension of the dimple 8 is different to some extent from the dimension of the corresponding dimple 8. The difference in dimension is preferably equal to or less than 0.5 mm, and more preferably equal to or less than 0.3 mm. The dimension means the length of the longest line segment which can be depicted over the contour of the dimple 8. In the case of the circular dimple 8, the dimension refers to the diameter of the same.

The dimple pattern on the first spherical regular triangle T1 has a line symmetry with respect to an axis line AL in the plan view. This dimple pattern has three axes lines AL.

Figure 6:
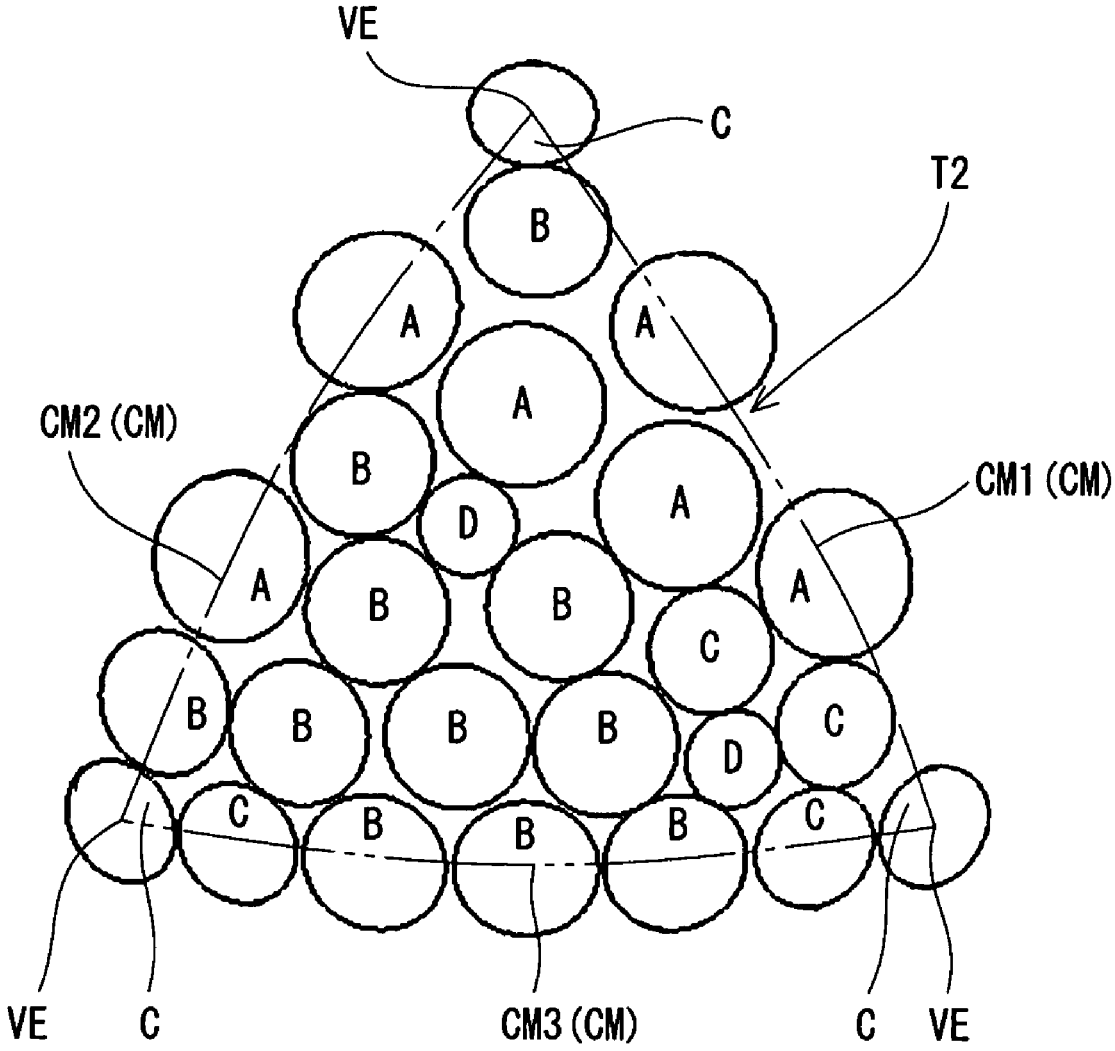
FIG. 6 shows a front view illustrating a second spherical regular triangle of the golf ball shown in FIG. 2.

FIG. 6 shows a front view illustrating a second spherical regular triangle T2. The second spherical regular triangle T2 has three comparting lines CM (CM1, CM2, CM3), and three vertices VE. The second spherical regular triangle T2 includes dimples A, dimples B, dimples C and dimples D. The dimple A has a diameter of 4.6 mm. The dimple B has a diameter of 4.0 mm. The dimple C has a diameter of 3.5 mm. The dimple D has a diameter of 2.7 mm. The second spherical regular triangle T2 has four types of the dimples 8 having a diameter different from each other.

At each vertex VE of the second spherical regular triangle T2, there exists the dimple C. The center of this dimple C agrees with the vertex VE. Comparting line CM1 intersects with two dimples A at there center except for the vertex VE. Comparting line CM2 intersects with two dimples A and one dimple B at there center except for the vertex VE. Comparting line CM3 intersects with three dimples B and two dimples C at there center except for the vertex VE. The second spherical regular triangle T2 has ten dimples 8 which intersect with the comparting line CM at their center. In the second spherical regular triangle T2, the number of the dimples 8 that intersect with the comparting line CM but do not intersect therewith at the center is zero.

The dimple pattern on the second spherical regular triangle T2 has neither rotational symmetry nor line symmetry. The dimple pattern on the second spherical regular triangle T2 is different from the dimple pattern on the first spherical regular triangle T1.

Figure 7:
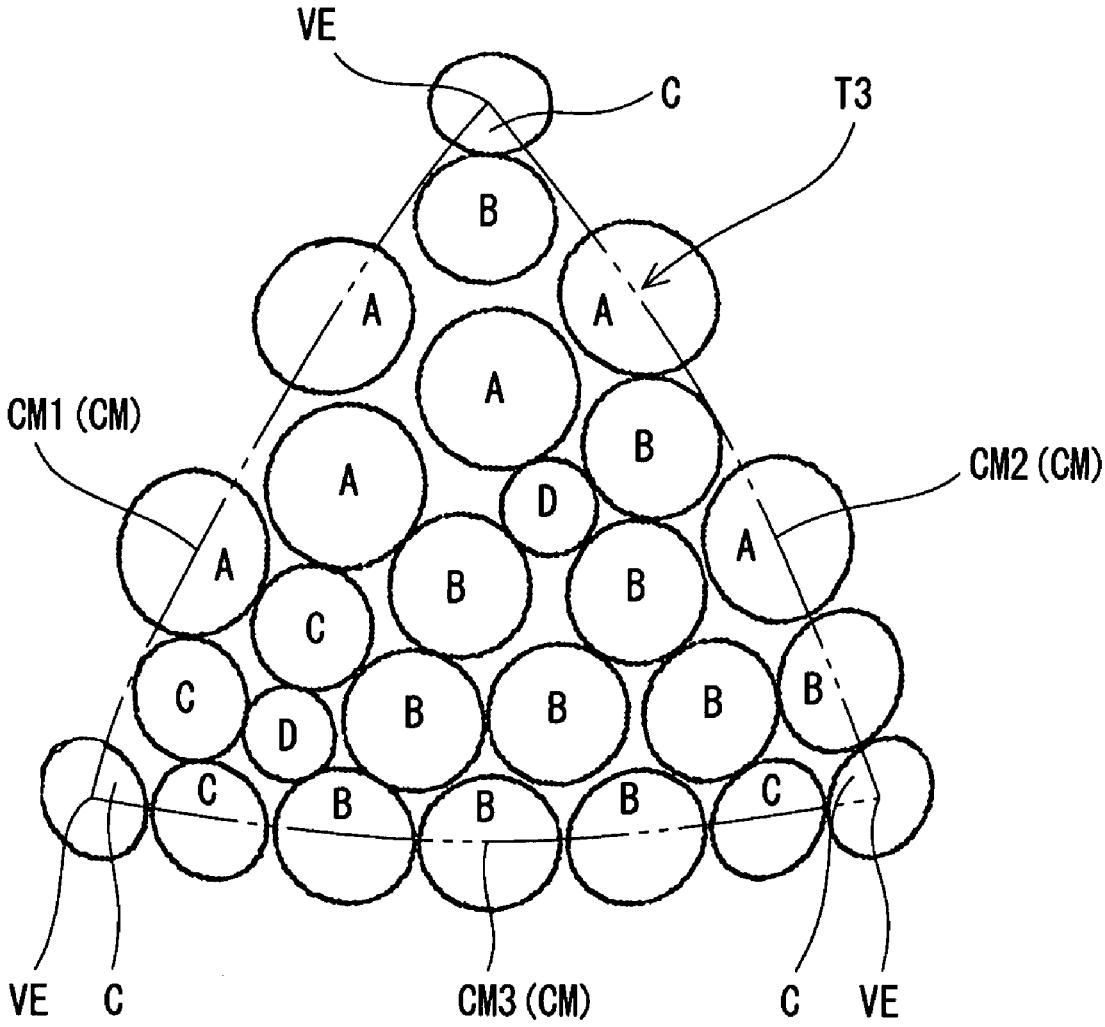
FIG. 7 shows a front view illustrating a third spherical regular triangle of the golf ball shown in FIG. 2.

FIG. 7 shows a front view illustrating a third spherical regular triangle T3. The third spherical regular triangle T3 has three comparting lines CM (CM1, CM2, CM3), and three vertices VE. The third spherical regular triangle T3 includes dimples A, dimples B, dimples C and dimples D. The dimple A has a diameter of 4.6 mm. The dimple B has a diameter of 4.0 mm. The dimple C has a diameter of 3.5 mm. The dimple D has a diameter of 2.7 mm. The third spherical regular triangle T3 has four types of the dimples 8 having a diameter different from each other.

At each vertex VE of the third spherical regular triangle T3, there exists the dimple C. The center of this dimple C agrees with the vertex VE. Comparting line CM1 intersects with two dimples A at there center except for the vertex VE. Comparting line CM2 intersects with two dimples A and one dimple B at there center except for the vertex VE. Comparting line CM3 intersects with three dimples B and two dimples C at there center except for the vertex VE. The third spherical regular triangle T3 has ten dimples 8 which intersect with the comparting line CM at their center. In the third spherical regular triangle T3, the number of the dimples 8 that intersect with the comparting line CM but do not intersect therewith at the center is zero.

The dimple pattern on the third spherical regular triangle T3 has neither rotational symmetry nor line symmetry. The dimple pattern on the third spherical regular triangle T3 is different from the dimple pattern on the first spherical regular triangle T1. The dimple pattern on the third spherical regular triangle T3 is also different from the dimple pattern on the second spherical regular triangle T2. The dimple pattern on the third spherical regular triangle T3 and the dimple pattern on the second spherical regular triangle T2 have a mirror symmetry with each other. Use of the two types of the dimple patterns having a mirror symmetry prevents deterioration of uniformity in the vicinity of the equatorial line EQ.

Figure 8:
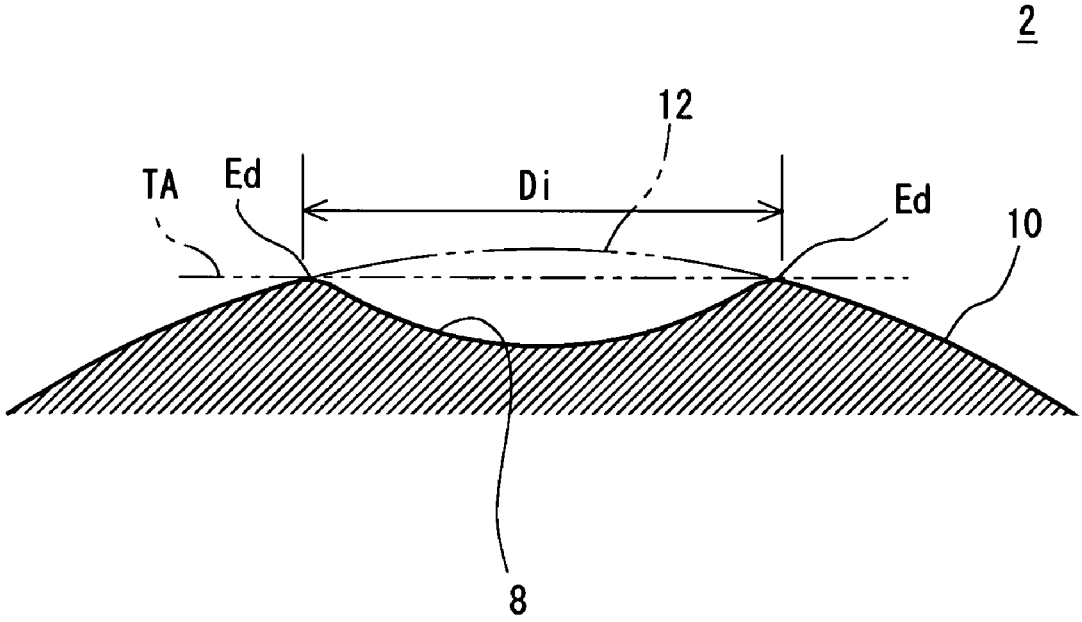
FIG. 8 shows an enlarged cross-sectional view illustrating a part of the golf ball shown in FIG. 1.

FIG. 8 shows an enlarged cross-sectional view illustrating a part of the golf ball 2 shown in FIG. 1. In this FIG. 8, a cross section along a plane passing through the center (the deepest point) of the dimple 8 and the center of the golf ball 2 is shown. A top-to-bottom direction in FIG. 8 is an in-depth direction of the dimple 8. What is indicated by a chain double-dashed line 12 in FIG. 8 is a phantom spherical surface. The phantom spherical surface 12 corresponds to the surface of the golf ball 2 when it is postulated that there is no dimple 8. The dimple 8 is recessed from the phantom spherical surface 12. The land 10 agrees with the phantom spherical surface 12.

In FIG. 8, what is indicated by a both-oriented arrowhead Di is the diameter of the dimple 8. This diameter Di is a distance between one contact point Ed and another contact point Ed, which are provided when a tangent line TA that is common to both sides of the dimple 8 is depicted. The contact point Ed is also an edge of the dimple 8. The edge Ed defines the contour of the dimple 8. The diameter Di is preferably 2.00 mm or greater and 6.00 mm or less. By setting the diameter Di to be equal to or greater than 2.00 mm, a great dimple effect can be achieved. In this respect, the diameter Di is more preferably equal to or greater than 2.20 mm, and particularly preferably equal to or greater than 2.40 mm. By setting the diameter Di to be equal to or less than 6.00 mm, fundamental feature of the golf ball 2 which is substantially a sphere is not hampered. In this respect, the diameter Di is more preferably equal to or less than 5.80 mm, and particularly preferably equal to or less than 5.60 mm.

In this golf ball 2, at all twelve vertices VE, there exists the dimple 8 the center of which agrees with the corresponding vertex VE. Furthermore, this golf ball 2 has many dimples 8 which intersect with the comparting line CM at their center. The dimples 8 present at the vertex VE, and the dimples 8 which intersect with the comparting line CM at their center are orderly arranged. Owing to this arrangement, characteristics of the regular icosahedron pattern of this golf ball 2 are not impaired irrespective of having the three types of the spherical regular triangles T1, T2 and T3. The dimple pattern of this golf ball 2 is excellent in uniformity. In light of the uniformity, the number of the dimples 8 which intersect with the comparting line CM at their center on each spherical regular triangle T1, T2, T3 is preferably six or greater, more preferably seven or greater, and particularly preferably eight or greater.

This golf ball 2 does not have a great circle path. Therefore, even when the equatorial line EQ agrees with the fastest part, deterioration of the dimple effect resulting from the great circle path is not caused. This golf ball 2 is excellent in the aerodynamic symmetry.

Also in production of this golf ball 2, the dimples 8 in the vicinity of the equatorial line EQ may be deformed to some extent by removing the flash. In this golf ball 2, the dimple patterns on the spherical regular triangles T2 and T3 including the equatorial line EQ are different from the dimple pattern on the spherical regular triangle T1 not including the equatorial line EQ. The dimple patterns of the spherical regular triangles T2 and T3 including the equatorial line EQ can compensate for the dimple effect when the equatorial line EQ agrees with the fastest part. This golf ball 2 is excellent in the aerodynamic symmetry also in the case in which the dimple 8 is deformed. Additionally, this golf ball 2 attains a great flight distance.

The number of types of the dimples 8 on the first spherical regular triangle T1 is two; the number of types of the dimples 8 on the second spherical regular triangle T2 is four; and the number of types of the dimples 8 on the third spherical regular triangle T3 is four. The number of types Ne on the spherical regular triangles T2 and T3 including the equatorial line EQ is different from the number of types Np of the spherical regular triangle T1 not including the equatorial line EQ. Owing to the difference in the number of types, the dimple patterns on the spherical regular triangles T2 and T3 including the equatorial line EQ can compensate for the dimple effect when the equatorial line EQ agree with the fastest part.

In this golf ball 2, the number of types Ne is greater than the number of types Np. In other words, many types of the dimples 8 are arranged in the vicinity of the equatorial line EQ. Accordingly, the air flow in the vicinity of the equatorial line EQ is disrupted more efficiently, whereby a greater dimple effect can be achieved. The difference (Ne-Np) is preferably equal to or greater than two.

As described above, the dimple pattern on the first spherical regular triangle T1 has both rotational symmetry and line symmetry. In contrast, the dimple patterns on the second spherical regular triangle T2 and third spherical regular triangle T3 have neither rotational symmetry nor line symmetry. The dimple patterns on the second spherical regular triangle T2 and the third spherical regular triangle T3 can disrupt the airflow more efficiently. Owing to the arrangement of the second spherical regular triangle T2 and the third spherical regular triangle T3 in the vicinity of the equatorial line EQ, these spherical regular triangles T2 and T3 can compensate the dimple effect when the equatorial line EQ agrees with the fastest part.

As described above, the dimple pattern on the second spherical regular triangle T2 is different from the dimple pattern on the third spherical regular triangle T3. In other words, the number of types of the spherical regular triangles including the equatorial line EQ is two. When the equatorial line EQ on this golf ball 2 agrees with the fastest part, the second spherical regular triangle T2 and the third spherical regular triangle T3 appear depending on the back spin. The dimple effect can be hereby compensated. The number of types of the spherical regular triangles including the equatorial line EQ may be equal to or greater than three. In light of the dimple effect, the number of the second spherical regular triangles T2 is preferably equal to or greater than four, more preferably equal to or greater than five, and most preferably six. In light of the dimple effect, the number of the third spherical regular triangles T3 is preferably equal to or greater than four, more preferably equal to or greater than five, and most preferably six. The number of types of the spherical regular triangles not including the equatorial line EQ may be equal to or greater than two.

According to conventional regular icosahedron pattern, the pole PL agrees with the vertex VE. In this case, the number of the spherical regular triangles including the equatorial line EQ is ten. When the pole PL agrees with the mid point of the comparting line CM, the number of the spherical regular triangles including the equatorial line EQ is eight. In the golf ball 2 shown in FIGS. 2 to 5, the pole PL agrees with the center of the spherical regular triangle T1. In this golf ball 2, the numbers of the spherical regular triangles T2 and T3 including the equatorial line EQ are twelve. In contrast, the number of the spherical regular triangles T1 not including the equatorial line EQ is eight. When the equatorial line EQ on this golf ball 2 agrees with the fastest part, many spherical regular triangles T2 and T3 appear depending on the back spin. Thus, the dimple effect can be compensated.

In light of possible contribution to the dimple effect of the individual dimples 8, the mean diameter of the dimple 8 is preferably equal to or greater than 3.6 mm, and more preferably equal to or greater than 3.8 mm. The mean diameter is preferably equal to or less than 5.50 mm. By setting the mean diameter to be equal to or less than 5.50 mm, fundamental feature of the golf ball 2 which is substantially a sphere is not deteriorated. The golf ball 2 shown in FIGS. 2 to 5 has 48 dimples A, 224 dimples B, 72 dimples C and 24 dimples D. Therefore, the mean diameter is 3.9 mm.

Area s of the dimple 8 is an area of a region surrounded by the contour line when the center of the golf ball 2 is viewed at infinity. In instances of a circular dimple 8, the area s is calculated by the following formula:

$$s=(Di/2)^2\cdot\pi$$

In the golf ball 2 shown in FIGS. 2 to 5, the area of the dimple A is 16.62 $mm^2$; the area of the dimple B is 12.57 $mm^2$; the area of the dimple C is 9.62 $mm^2$; and the area of the dimple D is 5.73 $mm^2$.

In the present invention, ratio of the sum total of the areas s of all the dimples 8 to the surface area of the phantom spherical surface 12 is referred to as an occupation ratio. From the standpoint that a sufficient dimple effect is achieved, the occupation ratio is preferably equal to or greater than 70%, more preferably equal to or greater than 72%, and particularly preferably equal to or greater than 74%. The occupation ratio is preferably equal to or less than 90%. According to the golf ball 2 shown in FIGS. 2 to 5, total area of the dimples 8 is 4443.6 $mm^2$. Because the surface area of the phantom spherical surface 12 of this golf ball 2 is 5728.0 $mm^2$, the occupation ratio is 77.6%.

In light of possible suppression of hopping of the golf ball 2, the depth of the dimple 8 is preferably equal to or greater than 0.05 mm, more preferably equal to or greater than 0.08 mm, and particularly preferably equal to or greater than 0.10 mm. In light of possible suppression of dropping of the golf ball 2, the depth is preferably equal to or less than 0.60 mm, more preferably equal to or less than 0.45 mm, and particularly preferably equal to or less than 0.40 mm. The depth is a distance between the tangent line TA and the deepest point of the dimple 8.

According to the present invention, the term "dimple volume" means a volume of a part surrounded by a plane that includes the contour of the dimple 8, and the surface of the dimple 8. In light of possible suppression of hopping of the golf ball 2, the total volume of the dimples 8 is preferably equal to or greater than 250 $mm^3$, more preferably equal to or greater than 260 $mm^3$, and particularly preferably equal to or greater than 270 $mm^3$. In light of possible suppression of dropping of the golf ball 2, the total volume is preferably equal to or less than 400 $mm^3$, more preferably equal to or less than 390 $mm^3$, and particularly preferably equal to or less than 380 $mm^3$.

From the standpoint that sufficient occupation ratio can be achieved, the total number of the dimples 8 is preferably equal to or greater than 200, more preferably equal to or greater than 250, and particularly preferably equal to or greater than 300. From the standpoint that individual dimples 8 can have a sufficient diameter, the total number is preferably equal to or less than 500, more preferably equal to or less than 440, and particularly preferably equal to or less than 400.

EXAMPLES

Example

A rubber composition was obtained by kneading 100 parts by weight of polybutadiene (trade name "BR-730", available from JSR Corporation), 30 parts by weight of zinc diacrylate, 6 parts of zinc oxide, 10 parts by weight of barium sulfate, 0.5 part by weight of diphenyl disulfide and 0.5 part by weight of dicumyl peroxide. This rubber composition was placed into a mold having upper and lower mold half each having a hemispherical cavity, and heated at 170° C. for 18 minutes to obtain a core having a diameter of 39.7 mm. On the other hand, 50 parts by weight of an ionomer resin (available from Du Pont-MITSUI POLYCHEMICALS Co., Ltd.; trade name "Himilan 1605"), 50 parts by weight of other ionomer resin (available from Du Pont-MITSUI POLYCHEMICALS Co., Ltd.; trade name "Himilan 1706") and 3 parts by weight of titanium dioxide were kneaded to obtain a resin composition. The aforementioned core was placed into a final mold having numerous pimples on the inside face, followed by injection of the aforementioned resin composition around the spherical body by injection molding to form a cover having a thickness of 1.5 mm. Numerous dimples having a shape inverted from the shape of the pimple were formed on the cover. A clear paint including a two-part liquid curable polyurethane as a base was applied on this cover to give a golf ball of Example having a diameter of 42.7 mm and a weight of about 45.4 g. This golf ball has a PGA compression of about 85. This golf ball has a dimple pattern shown in FIGS. 2 to 7. Details of specifications of the dimples are presented in Table 1 below.

Comparative Example

Figure 9:
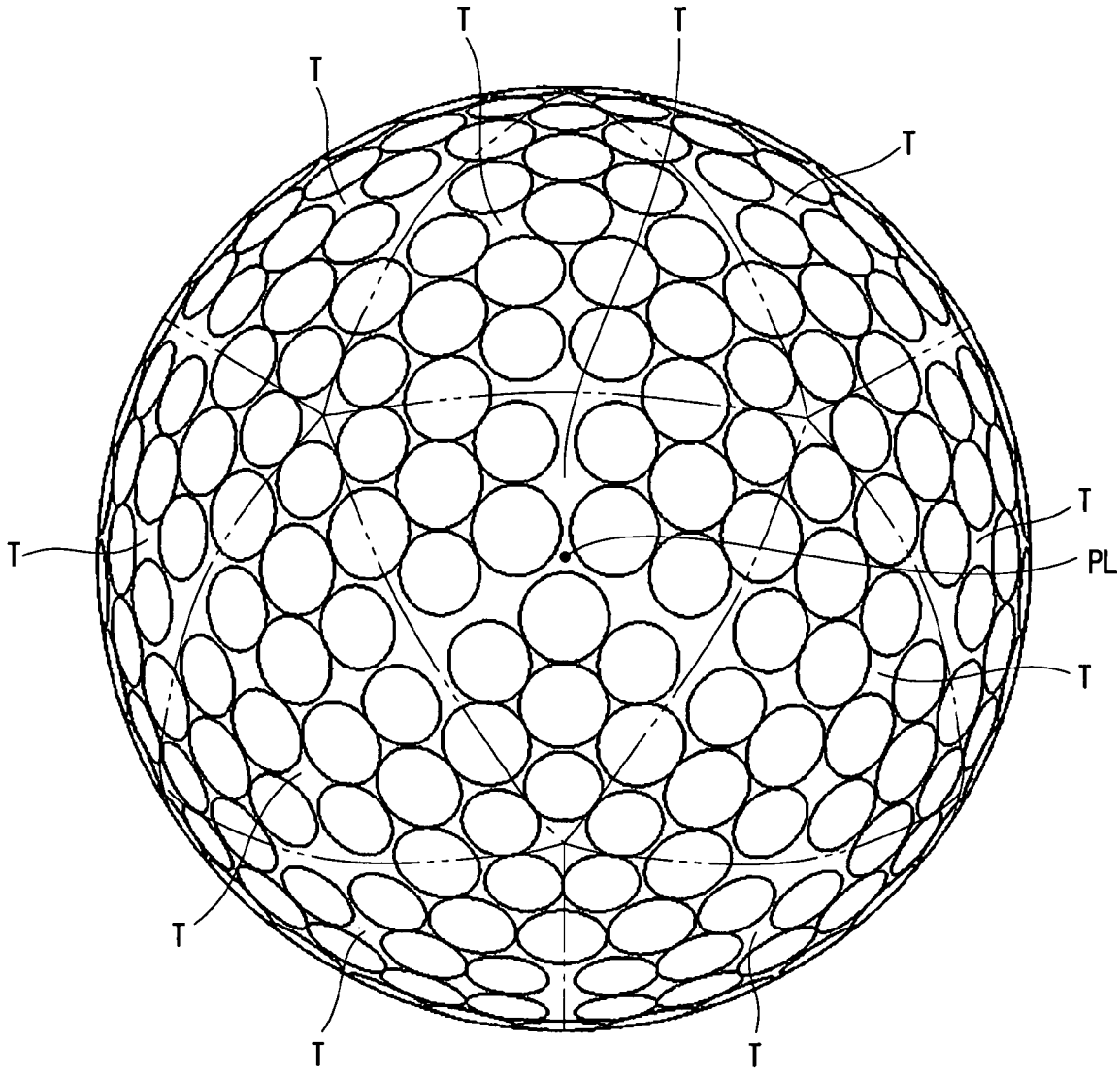
FIG. 9 shows a plan view illustrating a golf ball according to Comparative Example.
Figure 10:
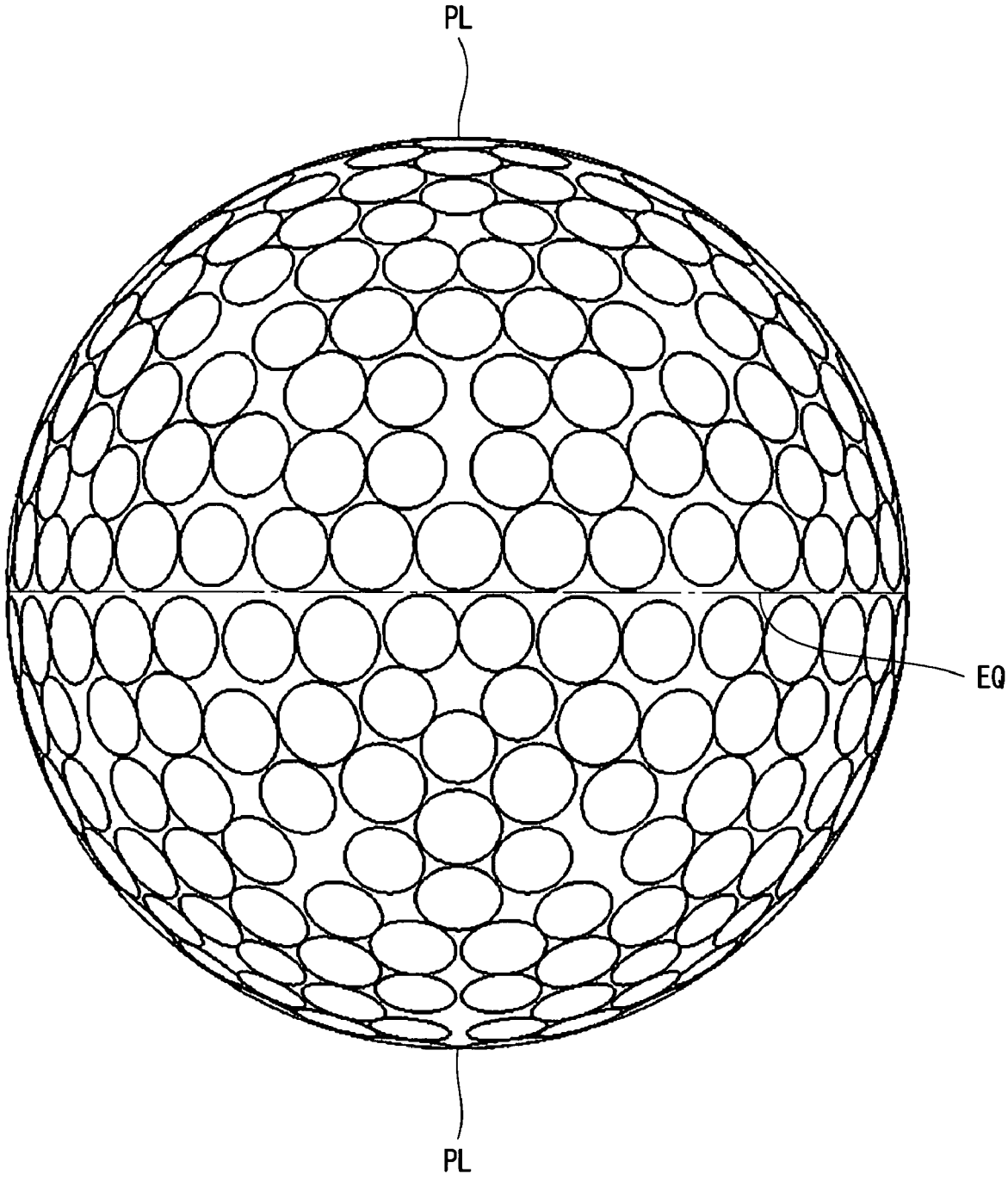
FIG. 10 shows a front view illustrating the golf ball shown in FIG. 9.
Figure 11:
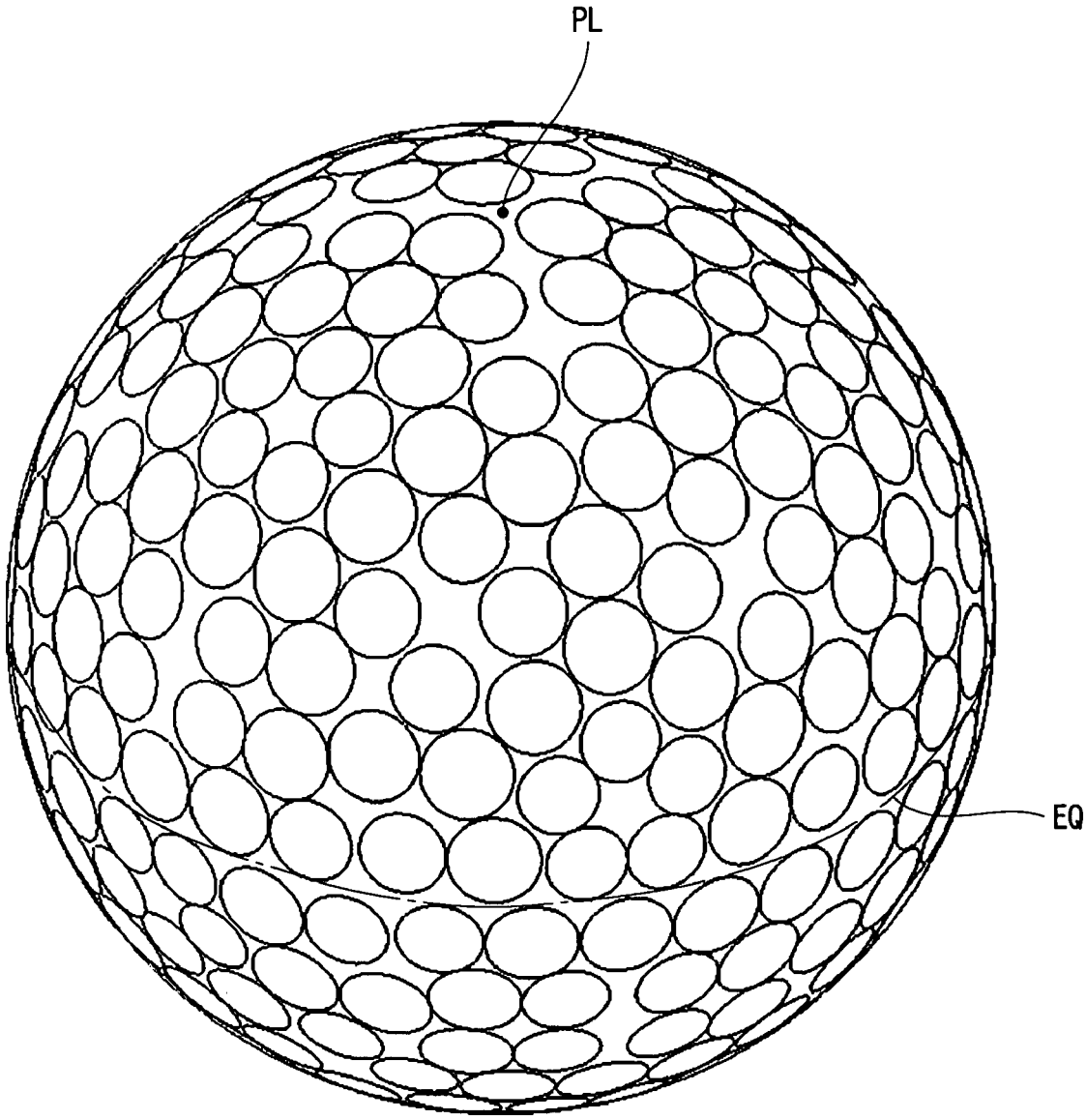
FIG. 11 shows a perspective view illustrating the golf ball shown in FIG. 9.
Figure 12:
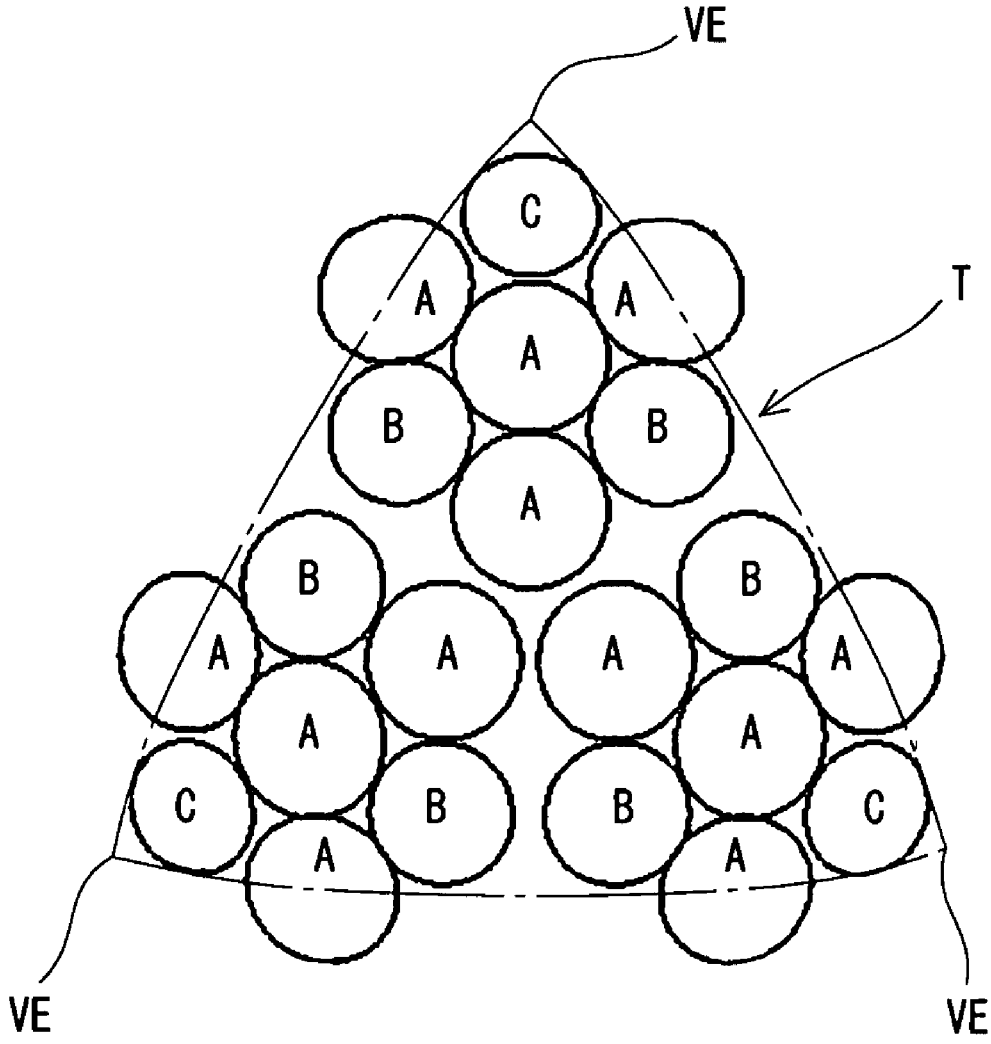
FIG. 12 shows a front view illustrating a spherical regular triangle of the golf ball shown in FIG. 9.

Golf ball of Comparative Example was obtained in a similar manner to Example except that the dimples were formed by another final mold so that their specifications were as shown in Table 1 below. FIG. 9 shows a plan view illustrating the golf ball of Comparative Example; FIG. 10 shows its front view; and FIG. 11 shows a perspective view of the same. This golf ball has a regular icosahedronal dimple pattern. This golf ball is comparted into twenty spherical regular triangles T. FIG. 12 shows a dimple pattern on this spherical regular triangle T. The dimple pattern on the twenty spherical regular triangles T is almost identical. However, for the sake of convenience for formation of the parting line of the mold, positions of the dimples in the vicinity of the equatorial line are modified.

TABLE 1

Specification of dimples

| | | Number | Diameter (mm) | Depth (mm) | Curvature radius (mm) | Volume ($mm^3$) |
|---|---|---|---|---|---|---|
| Example | Dimple A | 48 | 4.60 | 0.140 | 18.96 | 1.165 |
| | Dimple B | 224 | 4.00 | 0.140 | 14.36 | 0.881 |
| | Dimple C | 72 | 3.50 | 0.140 | 11.01 | 0.675 |
| | Dimple D | 24 | 2.70 | 0.140 | 6.58 | 0.402 |
| Comparative Example | Dimple A | 180 | 4.15 | 0.140 | 15.45 | 0.948 |
| | Dimple B | 120 | 3.85 | 0.140 | 13.30 | 0.816 |
| | Dimple C | 60 | 3.60 | 0.140 | 11.64 | 0.714 |

Travel Distance Test

A driver with a titanium head (trade name "XXIO", available from SRI Sports Limited, shaft hardness: X, loft angle: 9°) was attached to a swing machine, available from True Temper Co. Then the golf ball was hit under the condition to provide a head speed of 49 m/sec, a launch angle being about 11° and give the backspin rate of about 3000 rpm. Accordingly, the distance from the launching point to the point where the ball stopped was measured. Under the condition during the test, it was almost windless. Mean values of twenty measurements on pole shot and seam shot were calculated, respectively. On the pole shot, the golf ball is hit such that a straight line on a plane including the equatorial line corresponds to the rotation axis of the back spin. On the seam shot, the golf ball is hit such that a straight line connecting both poles corresponds to the rotation axis of the back spin. The results are presented in Table 2 below.

TABLE 2

Evaluation results

| | | Example | Comparative Example |
|---|---|---|---|
| Dimple pattern | | Regular icosahedron | Regular icosahedron |
| Dimple total number | | 368 | 360 |
| Total volume ($mm^3$) | | 311.5 | 311.5 |
| Occupation ratio (%) | | 77.6 | 77.6 |
| Number of great circle path | | 0 | 1 |
| Spherical Regular triangle Including equatorial line | Dimple at vertex | Present | Absent |
| | Number of dimples intersecting at the center | 10 | 6 |
| | Number of types of dimples | 4 | 3 |
| Spherical regular triangle not including equatorial line | Dimple at vertex | Present | Absent |
| | Number of dimples intersecting at the center | 15 | 6 |
| | Number of types of dimples | 2 | 3 |
| Number of spherical regular triangle including equatorial line | | 12 | 12 |
| Number of type of spherical regular triangle including equatorial line | | 2 | 1 |
| Number of spherical regular triangle not including equatorial line | | 8 | 8 |
| Number of type of spherical regular triangle not including equatorial line | | 1 | 1 |
| Travel Distance (m) | pole shot | 245.6 | 243.5 |
| | seam shot | 245.0 | 241.9 |
| | Difference between pole shot and seam shot | 0.6 | 1.6 |

As shown in Table 2, the difference in the pole shot and the seam shot is small according to the golf ball of Example. Moreover, the golf ball of Example achieved greater flight distance than that of the golf ball of Comparative Example. Therefore, advantages of the present invention are clearly suggested by these results of evaluation.

The dimple pattern explained hereinabove can be applied to not only two-piece golf balls, but also one-piece golf balls, multi-piece golf balls and wound golf balls. The foregoing description is just for illustrative examples, and various modifications can be made in the scope without departing from the principles of the present invention.

What is claimed is:

1. A golf ball having numerous dimples on the surface thereof, wherein the golf ball does not have a great circle which does not intersect with the dimple, when a phantom spherical surface thereof is comparted by thirty comparting lines, being formed by projecting thirty edges of a regular icosahedron inscribed in the phantom spherical surface on the phantom spherical surface, into spherical regular icosahedrons consisting of multiple spherical regular triangles including the equatorial line and multiple spherical regular triangles not including the equatorial line, the dimple pattern on the spherical regular triangle not including the equatorial line being different from the dimple pattern on the spherical regular triangle including the equatorial line, and the golf ball comprises twelve spherical regular triangles including the equatorial line, and eight spherical regular triangles not including the equatorial line.

2. The golf ball according to claim 1, wherein at all twelve vertices of the spherical regular icosahedrons, there exists a dimple the center of which agrees with the corresponding vertex, and all the spherical regular triangles have six or more dimples the center of which agrees with the comparting line, respectively.

3. The golf ball according to claim 1, wherein the number of types of the dimples on one spherical regular triangle including the equatorial line is different from the number of types of the dimples on one spherical regular triangle not including the equatorial line.

4. The golf ball according to claim 3, wherein the number of types of the dimples on the one spherical regular triangle including the equatorial line is greater than the number of types of the dimples on the one spherical regular triangle not including the equatorial line.

5. The golf ball according to claim 1, wherein the dimple pattern on the spherical regular triangle including the equatorial line has neither rotational symmetry nor line symmetry.

6. The golf ball according to claim 1, comprising a spherical regular triangle including the equatorial line and having a certain dimple pattern, and a spherical regular triangle including the equatorial line and having other dimple pattern, wherein the certain dimple pattern is different from the other dimple pattern.

7. The golf ball according to claim 1, comprising a spherical regular triangle not including the equatorial line and having a certain dimple pattern, and a spherical regular triangle not including the equatorial line and having other dimple pattern, wherein the certain dimple pattern is different from the other dimple pattern.

* * * * *